US008053965B2

(12) United States Patent
Boehler et al.

(10) Patent No.: US 8,053,965 B2
(45) Date of Patent: Nov. 8, 2011

(54) COMBINATION IGNITER AND SENSOR FOR AN INTERNAL COMBUSTION ENGINE

(75) Inventors: Jeffrey T. Boehler, Holland, OH (US); Matthew B. Below, Findlay, OH (US); Edward A. VanDyne, Loveland, CO (US)

(73) Assignee: Fram Group IP, LLC, Danbury, CT (US)

( * ) Notice: Subject to any disclaimer, the term of this patent is extended or adjusted under 35 U.S.C. 154(b) by 609 days.

(21) Appl. No.: 12/114,415

(22) Filed: May 2, 2008

(65) Prior Publication Data

US 2008/0272683 A1 Nov. 6, 2008

Related U.S. Application Data

(60) Provisional application No. 60/915,668, filed on May 2, 2007.

(51) Int. Cl.
*H01T 13/20* (2006.01)

(52) U.S. Cl. ..... 313/141; 445/7

(58) Field of Classification Search ..... 313/118–145, 313/238; 445/7; 140/174.5
See application file for complete search history.

(56) References Cited

U.S. PATENT DOCUMENTS

| | | | | |
|---|---|---|---|---|
| 4,092,558 | A | | 5/1978 | Yamada |
| 4,476,412 | A | | 10/1984 | Nishida et al. |
| 4,631,451 | A | | 12/1986 | Anderson et al. |
| 4,695,758 | A | | 9/1987 | Nishida et al. |
| 4,730,582 | A | | 3/1988 | Lindsay |
| 4,798,991 | A | | 1/1989 | Benedikt et al. |
| 5,180,983 | A | * | 1/1993 | Murata et al. ..... 324/399 |
| 5,180,984 | A | * | 1/1993 | Murata et al. ..... 324/399 |
| 5,697,334 | A | | 12/1997 | Below |
| 5,721,655 | A | | 2/1998 | Thweatt |
| 5,731,654 | A | | 3/1998 | Benedikt et al. |
| 5,734,094 | A | * | 3/1998 | Matsubara et al. ..... 324/402 |
| 5,918,571 | A | | 7/1999 | Below |
| 5,950,584 | A | | 9/1999 | Bubeck |
| 6,104,130 | A | | 8/2000 | Below |

FOREIGN PATENT DOCUMENTS

| | | | |
|---|---|---|---|
| JP | 2002289318 | A | 10/2002 |
| KR | 2020000000821 | U | 1/2000 |

OTHER PUBLICATIONS

Machine translation of Oh.*
International Search Report Dated Dec. 4, 2008, International Application No. PCT/US2008/062447.
Written Opinion of International Searching Authority Dated Dec. 4, 2008, International Application No. PCT/US2008/062447.
Colorado State University Master of Science Thesis of Clark Paterson; Oct. 2006.

(Continued)

*Primary Examiner* — Peter Macchiarolo
(74) *Attorney, Agent, or Firm* — Cantor Colburn, LLP

(57) ABSTRACT

An igniter for an internal combustion engine, the igniter comprising: a center electrode; an insulator disposed about the center electrode; a ground shield disposed about the insulator, the insulator having a tip portion extending past an end portion of the ground shield and a tip portion of the center electrode extending through and away from the tip portion of the insulator; and a spark gap disposed between the tip portion of the center electrode and the end portion of the ground shield.

12 Claims, 3 Drawing Sheets

OTHER PUBLICATIONS

"Ion Current in a Spark Ignition Engine using Negative Polarity on Center Electrode"; Sae Technical Paper Series; presented at 2007 SAE World Congress & Exhibition, Apr. 16, 2007.

"Development of a Diesel Particulate Filter Burner Control System for Active Trap Regeneration"; Sae Technical Paper Series; presented at 2007 SAE World Congress & Exhibition, Apr. 16, 2007.

Powerpoint presentation made by Clark Paterson in defense of master Thesis; Oct. 16, 2006.

SmartFire brochure given out at 2006 SAE Commercial Vehicle Engineering Congress & Exhibition, Oct. 31, 2006.

Color copies of pp. 85-89 of Colorado State University Master of Science Thesis of Clark Paterson; Oct. 2006.

* cited by examiner

COMBINATION IGNITER AND SENSOR FOR AN INTERNAL COMBUSTION ENGINE

CLAIM OF PRIORITY

This application claims the benefit of U.S. patent application Ser. No. 60/915,668, filed May 2, 2007, the contents of which are incorporated herein by reference thereto.

BACKGROUND

Exemplary embodiments of the present invention relate to a spark plug or igniter for an internal combustion engine, and more particularly to a spark plug/igniter that initiates combustion, facilitates combustion control and bums off soot deposits in a diesel engine.

Soot is a common byproduct of the incomplete combustion of fuel in internal combustion engines namely, diesel engines. In particular, conventional fuels are comprised of hydrocarbons, which after undergoing complete combustion, produce byproducts of only carbon dioxide and water. However, complete combustion does not typically occur in internal combustion engines since no known engine is entirely efficient. In addition, complete combustion can require a lean fuel-air mixture whereas typical engine conditions require richer fuel-air mixtures to produce a desired performance.

Further, emission regulations are mandating the use of new engine combustion cycles such as homogeneous charge compression ignition (HCCI) and exhaust treatment systems for diesel engines. These new combustion cycles will require new methods for combustion sensing and control. There may also be certain engine load conditions where more conventional combustion cycles still work best. For these conditions, spark assist is one means of controlling the combustion process. This unique combination of needs for in-cylinder combustion sensing and combustion initiation can be supported with a spark plug designed to work well in the higher pressure diesel engine cylinder environment as an igniter and also as an ion sensor for combustion feedback and control. In another aspect, for exhaust treatment, better methods are needed to actively regenerate particulate filters. One method for active regeneration of a particulate filter is to provide a self contained burner system to add heat energy to the exhaust gas to initiate a regeneration cycle of the particulate filter. This burner system requires a reliable igniter that can survive in the corrosive and turbulent diesel exhaust environment.

In addition, soot typically accumulates at a higher rate in diesel engines than in gasoline engines due to the different ways that fuel is injected and ignited. In particular, in gasoline engines, fuel is injected during the intake stroke and thoroughly mixed with air before ignition by a spark. Conversely, in diesel engines, fuel is injected during the compression stroke and ignited spontaneously from the pressure. In that respect, combustion occurs at the boundary of unmixed fuel, where localized pockets of rich fuel-air mixtures are ignited thus producing soot.

Soot deposits can accumulate on insulator tips of conventional spark plugs. The exposed surface of the insulator tip is typically located at or near the boundary of unmixed fuel. Moreover, the exposed surface of the insulator tip is not typically located in or about the spark gap between the side electrode and the center electrode. In particular, the typical spark plug includes a center electrode extending past an insulator tip and a side electrode extending past the center electrode. For these reasons, soot may accumulate on the insulator tip and not be burned off.

Accordingly, it is desirable to provide a spark plug/igniter design that is more robust than conventional spark plug designs to high cylinder pressures, resistant to the corrosive effects of the combustion chamber or exhaust and resistant to soot buildup.

SUMMARY OF THE INVENTION

Exemplary embodiments of the present invention provide an igniter configured to maintain operability through application of a high energy surface spark while also providing combustion sensing capabilities.

In accordance with a non-limiting exemplary embodiment of the present invention, an igniter is provided, the igniter comprising: a center electrode; an insulator disposed about the center electrode; a ground shield disposed about the insulator, the insulator having a tip portion extending past an end portion of the ground shield and a tip portion of the center electrode extending through and away from the tip portion of the insulator; and a spark gap disposed between the tip portion of the center electrode and the end portion of the ground shield.

In accordance with another non-limiting exemplary embodiment of the present invention, an igniter for an internal combustion engine is provided, the igniter comprising: a center electrode; an insulator disposed about the center electrode; a ground shield disposed about the insulator, the insulator having a tip portion extending past an end portion of the ground shield and a tip portion of the center electrode extending through and away from the tip portion of the insulator; an outer shell portion disposed over a portion of the insulator and a portion of the ground shield, the outer shell portion having a motor seat portion disposed proximate to the portion of the ground shield being covered by the outer shell portion; a threaded portion being formed in the outer shell portion, the treaded portion being located above the motor seat portion; and a spark gap disposed between the tip portion of the center electrode and the end portion of the ground shield.

In accordance with another non-limiting exemplary embodiment of the present invention a combustion control system for an internal combustion engine is provided, the system comprising: a center electrode; an insulator disposed about the center electrode; a ground shield disposed about the insulator, the insulator having a tip portion extending past an end portion of the ground shield and a tip portion of the center electrode extending through and away from the tip portion of the insulator; an ion sensing portion disposed about the tip portion of the center electrode; a spark gap disposed between an outer periphery of the ion sensing portion and the end portion of the ground shield; and an electronic control unit coupled to the center electrode, the electronic control unit being configured to receive and transmit signals to and from the ion sensing portion via the center electrode, wherein some of the signals are indicative of ions located proximate to the ion sensing portion.

The above-described and other features and advantages will be appreciated and understood by those skilled in the art from the following detailed description, drawings, and appended claims.

BRIEF DESCRIPTION OF THE DRAWINGS

Other objects, features, advantages and details appear, by way of example only, in the following detailed description of embodiments, the detailed description referring to the drawings in which.

DETAILED DESCRIPTION OF EXEMPLARY EMBODIMENTS

Figure 1:
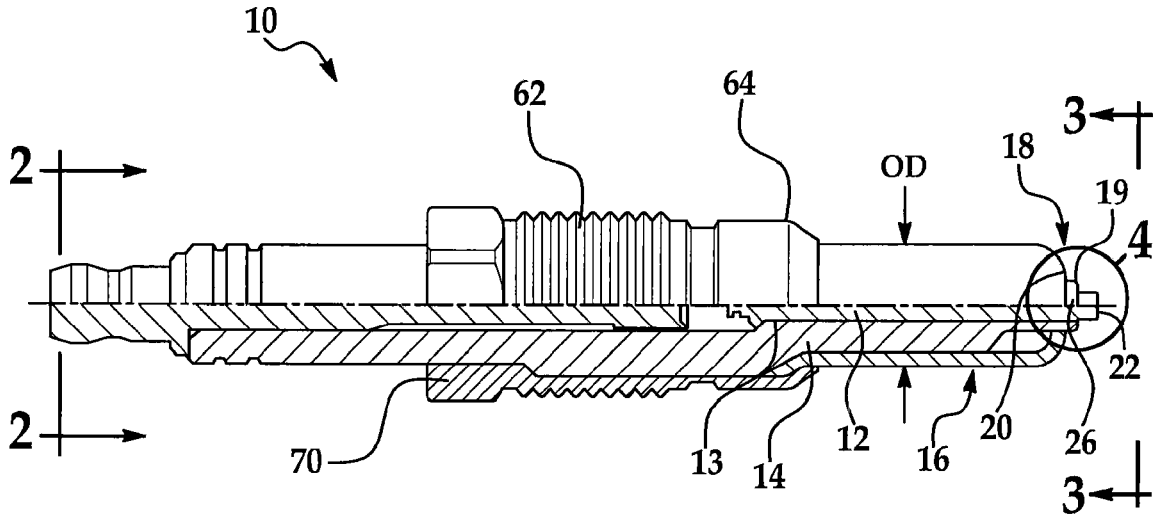
FIG. 1 is a partial cross-sectional view of an igniter, in accordance with a non-limiting exemplary embodiment of the present invention.
Figure 2:
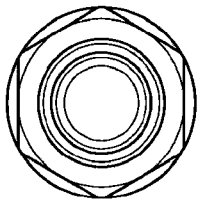
FIG. 2 is a view along lines 2-2 of FIG. 1.
Figure 3:
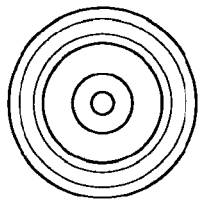
FIG. 3 is a view along lines 3-3 of FIG.

Exemplary embodiments of the present invention relate to an igniter or igniter/ion sensor for high compression engines. Exemplary embodiments of the present invention are related to U.S. Pat. No. 5,697,334, the contents of which are incorporated herein by reference thereto.

In accordance with an exemplary embodiment, and as illustrated in the attached drawings, a "high thread" spark plug is provided with a circular side electrode shape that allows for the spark energy to pass over the ceramic insulator tip surface thereby creating the igniter of exemplary embodiments of the present invention. In a non-limiting exemplary embodiment, the side electrode is made of a high nickel or stainless steel alloy having a 8 millimeter (mm) or a 10 mm diameter or any range therebetween as well as diameter greater or less than 8 and 10 mm. Although, the dimensions greater or less than the aforementioned diameters are considered to be within the scope of exemplary embodiments of the present invention. In addition and in accordance with non-limiting exemplary embodiments of the present invention, the distance between the tip of the center electrode and the side electrode has been in the range of 2 mm to 10 mm. Furthermore, the diameter of the center electrode tip may be increased by attaching a metal disk to improve ion sensing capability of the center electrode.

In accordance with one exemplary embodiment, the spark plug must be able to produce a sufficiently high energy spark over the non-conductive ceramic insulator tip to burn off the soot formed on the insulator tip. In accordance with another exemplary embodiment, the device described herein uses a center electrode with an ion sensing portion or annular disc portion to emit a spark along the insulator tip and to detect an ion current in a combustion cylinder into which the igniter is disposed. However, it is also contemplated that the igniter can instead have a center electrode without a separately added ion sensing portion, wherein the tip of the center electrode extending past the insulator becomes the ion sensing portion.

Referring to FIGS. 1-4, there is shown an igniter or igniter/ion sensor 10 for a high compression engine. In accordance with a non-limiting exemplary embodiment the igniter or igniter/ion sensor or spark plug 10 includes a center electrode 12 disposed in a center bore 13 of an insulator 14 disposed about the center electrode 12, and a ground shield 16 is disposed about the insulator 14. In accordance with an exemplary embodiment of the present invention a tip portion 18 of the insulator 14 extends past an end portion 20 of the ground shield 16. Tip portion 18 terminates at an end 19. Furthermore, a tip portion 22 of the center electrode 12 extends past the end of tip portion 18.

Accordingly, and as illustrated, a spark gap 24 extends from the tip portion of the center electrode to the ground shield. The spark gap also extending along a surface 26 of the tip portion 18 of the insulator 14. In one exemplary embodiment and in order to "burn off" or remove soot accumulated on surface 26 a high voltage is passed through the center electrode to heat up the surface and burn away accumulated soot.

In one non-limiting exemplary embodiment, the spark gap 24 has a frustoconical shape defined by tip portion 18 of the insulator wherein an outer periphery of the tip portion diverges between end 19 of the tip portion 22 of the center electrode and the end portion 20 of the ground shield 16. In that respect, the spark plug 10 has a stepped outer diameter 28 from the tip portion 22 of the center electrode 12 to the end portion 20 of the ground shield 16.

Figure 5:
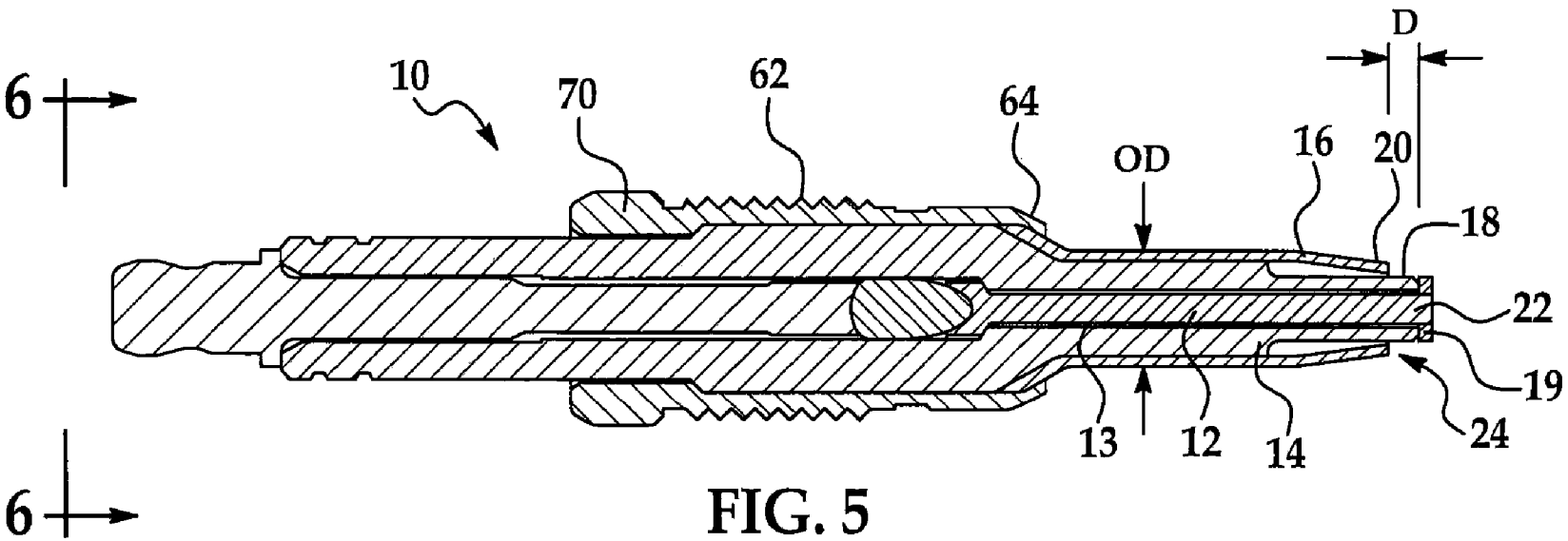
FIG. 5 is a cross-sectional view of an igniter, in accordance with another exemplary embodiment of the present invention.

As depicted in FIG. 5 and in one non-limiting exemplary embodiment, the distance D between the tip portion 22 of the center electrode 12 and the end portion 20 of the ground shield is substantially in the range between 1.7 millimeters and 10 millimeters. For instance and in one exemplary embodiment, the distance D is 2.23 millimeters. However, it is contemplated that the distance can instead be more or less than the above range as desired.

In one exemplary embodiment, the ground shield 16 has an outer diameter OD that is substantially in the range between 8 millimeters and 10 millimeters. It is understood that the outer diameter OD can instead be more or less than this range. The end portion 20 of the ground shield 16 has a frustoconical portion 30 converging toward the tip portion 22 of the center electrode 12. In this non-limiting exemplary embodiment, the ground shield 14 is formed from a nickel alloy. However, it is contemplated that the ground shield 16 can instead be formed from stainless steel or various other suitable materials as desired.

Figure 4:
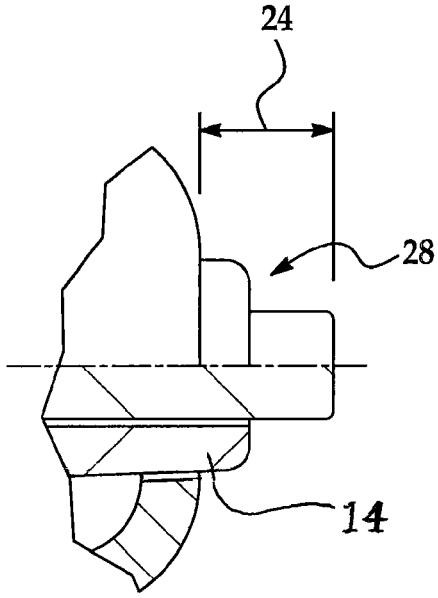
FIG. 4 is an enlarged view of a portion of FIG. 1.

Ground shield 16 may be straight or contoured along a length thereof depending on the requirements of a given application. Similarly, insulator 14, or tip portion 18 of insulator 14, may also be straight or contoured along a length thereof depending requirements of a given application. Such contours may include one or more change in diameter of an interior or exterior portion of the ground shield or insulator. Such contours may also include one or more slopped surface contours extending along a length of the ground shield or insulator, on the interior or exterior portion thereof. In one exemplary embodiment, insulator 14 and ground shield 16 are positioned, contoured or orientated with respect to one another to limit or substantially prevent deposits of combustion product material (e.g., soot) or other material from entering into sensor or sparkplug 10. For example, as shown in FIG. 5, the ground shield may include a gradual change in an inner and outer diameter (e.g., slope) for closing a gap between the ground shield and insulator. Similarly, as shown in FIG. 4, the insulator may also include a gradual change in an outer diameter for closing a gap between the ground shield and insulator. In another example, as shown in FIG. 1, ground shield 16 may be shaped for closing a gap between the ground shield and insulator. Other configurations are possible.

Figure 6:
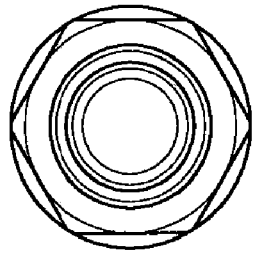
FIG. 6 is a view along lines 6-6 of FIG. 5.

As depicted in the non-limiting alternative exemplary embodiment of FIG. 6, the center electrode 12 also includes an ion sensing portion 32, which surrounds the tip portion of the center electrode. In accordance with an exemplary embodiment of the present invention, the ion sensing portion 32 is an annular disc portion that is disposed over the tip portion extending from the end portion of the insulator. Of course, other configurations of the ion sensing portion are considered to be with the scope of exemplary embodiments of the present invention. In accordance with an exemplary embodiment and when the ion sensing portion 32 (e.g., disc portion or other configuration) is disposed on the center electrode, the spark gap 24 extends between an outer periphery 33 of the annular disc portion 32 and the end portion 20 of the ground shield 16.

In accordance with an exemplary embodiment of the present invention, the ion sensing portion 32 is used to provide an ion sensing means as part of the igniter. In accordance with an exemplary embodiment, the annular disc portion is made from a nickel alloy and the ion sensing means is contemplated for use with a combustion control system 34 ("system") as exemplified in the non-limiting embodiment depicted in FIG. 8.

In this non-limiting exemplary embodiment, the distance D between the end portion 20 of the ground shield 16 and the annular disc portion 32 of the center electrode 12 is about 2.23 millimeters. However, it is contemplated that the distance D can be more or less than 2.23 millimeters.

Figure 8:
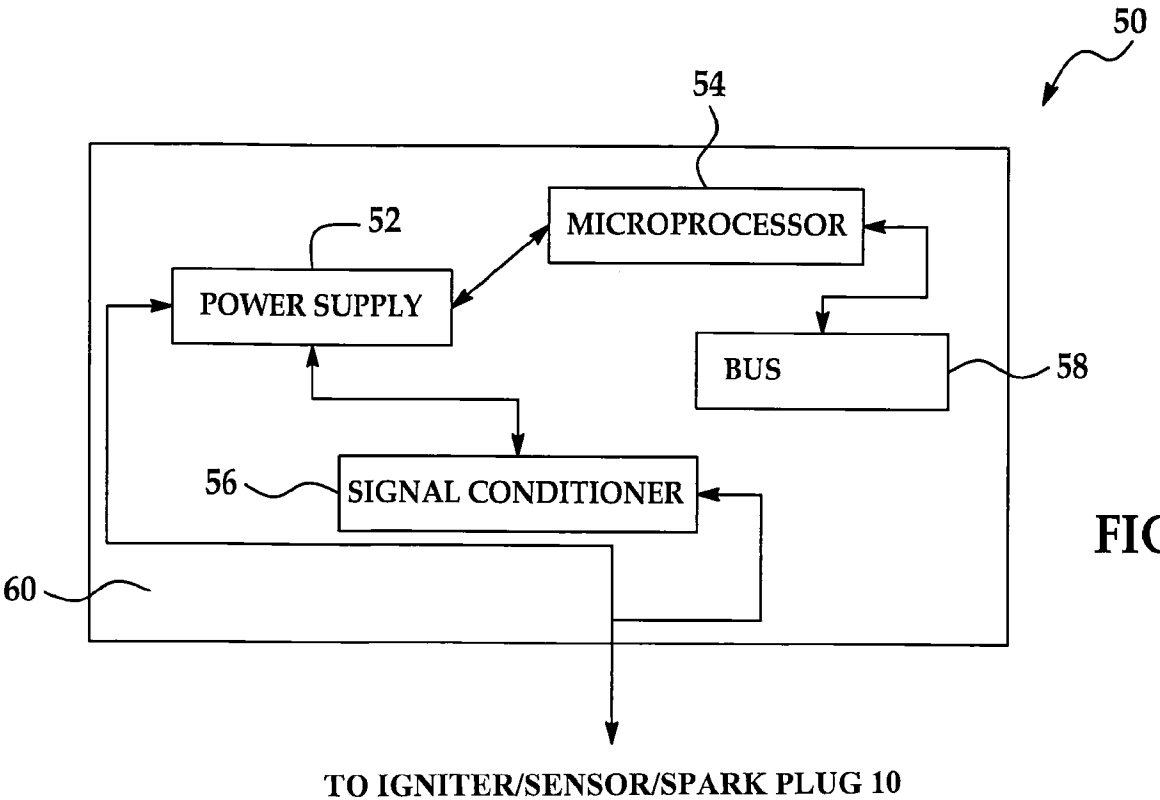
FIG. 8 is a schematic illustrating a control system in accordance with an exemplary embodiment of the present invention.

Turning now to the schematic of FIG. 8 an electronic control module 50 is operably coupled to the igniter to receive signals and provide voltage to the igniter. The module may be a separate module or may be part of an ignition control module or part of an engine control module. The electronic module has a power supply 52 for providing a controlled voltage signal, based upon alternating current (AC) or direct current (DC), to the electrode of the igniter when commanded by a microprocessor 54 of the control module. The microprocessor instructs the power supply to provide power to the electrode as well as receives ion current signals from the electrode via annular disc portion or ion sensing portion 32 disposed over the electrode tip via a conditioning module 56, that contains the necessary components to perform the steps required to analyze the ion signals sensed by the annular disc portion to determine the onset of combustion stability and instability, and communicates with other modules such as an engine control module through an interface or bus 58. In accordance with an exemplary embodiment conditioning module 56 receives signals from the electrode via lines 60 and performs any required filtering or amplification.

Figure 7:
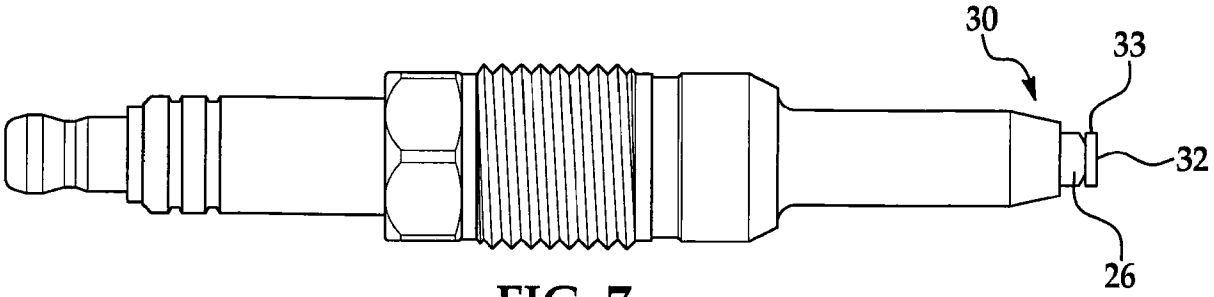
FIG. 7 is a side view of the igniter shown in FIG. 5.

In accordance with an exemplary embodiment and as illustrated in FIGS. 1, 5 and 7 the igniter has a threaded portion 62, which is disposed above a motor seat portion 64 of the igniter. Accordingly and as the igniter is secured to a threaded opening (not shown) of an engine or other device, the threaded portion 62 pushes the seat portion against the motor seat in order to provide an effective seal therebetween.

Furthermore, igniter 10 has a first outer shell portion 70 that includes the threaded portion and the motor seat portion, wherein the first outer shell portion disposes the motor seat portion over an upper portion of the ground shield. In accordance with an exemplary embodiment of the present invention the motor seat portion is configured to have 60 degree angle as shown in the drawings. Of course, other configurations are considered to be within the scope of exemplary embodiments of the present invention.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. In combination an igniter and a sensor for an internal combustion engine, comprising:

a center electrode;

an insulator disposed about the center electrode;

a ground shield disposed about the insulator, the ground shield terminating at an end portion, the insulator having a portion extending past the end portion of the ground shield, wherein the portion of the insulator extending past the end portion of the ground shield terminates at a tip portion, and a portion of the center electrode extends through the insulator and terminates with an electrode tip portion that extends from the tip portion of the insulator;

an ion sensing portion located on the electrode tip portion; and wherein a spark gap is defined between a peripheral edge of the ion sensing portion and the end portion of the ground shield.

2. The igniter as in claim 1, wherein the spark gap extends along an outer periphery of the portion of the insulator that extends past the end portion of the ground shield.

3. The igniter as in claim 1, wherein the spark gap has a frusto conical shape diverging from the tip portion of the insulator to the end portion of the ground shield.

4. The igniter as in claim 2, wherein the outer periphery of the portion of the insulator decreases in dimension as is extends from the end portion of the ground shield.

5. The igniter as in claim 1, wherein the ground shield is formed from one of a nickel alloy and a stainless steel alloy.

6. The igniter as in claim 1, wherein the ion sensing portion is an annular disc portion disposed about the tip portion of the center electrode.

7. The igniter as in claim 6, wherein the spark gap extends between an outer periphery of the annular disc portion and the end portion of the ground shield.

8. The igniter as in claim 7, wherein the spark gap extends along an outer periphery of the portion of the insulator that extends past the end portion of the ground shield.

9. The igniter as in claim 1, wherein the end portion of the ground shield is configured to have a frustoconical portion converging toward an outer periphery of the portion of the insulator extending past the end portion of the ground shield and the ground shield has an outer diameter substantially in the range between 6 millimeters and 8 millimeters.

10. The igniter as in claim 1, wherein a distance between the electrode tip portion of the center electrode and the end portion of the ground shield is substantially in the range between 1.7 millimeters and 10 millimeters.

11. The igniter as in claim 1, wherein the ground shield has an outer diameter substantially in the range between 6 millimeters and 10 millimeters.

12. In combination an igniter and a sensor for an internal combustion engine, comprising:

a center electrode;

an insulator disposed about the center electrode;

a ground shield disposed about the insulator, the ground shield terminating at an end portion, the insulator having a first portion located within the ground shield in a facing spaced relationship and a second portion extending past the end portion of the ground shield the second portion of the insulator terminating at a tip portion, and a portion of the center electrode is surrounded by the insulator and has an electrode tip portion that extends from the tip portion of the insulator;

an ion sensing portion located on the electrode tip portion; and wherein a spark gap is defined between a peripheral edge of the ion sensing portion and the end portion of the ground shield.

* * * * *